US007136019B2

(12) United States Patent
Mikkola et al.

(10) Patent No.: US 7,136,019 B2
(45) Date of Patent: Nov. 14, 2006

(54) ANTENNA FOR FLAT RADIO DEVICE

(75) Inventors: Jyrki Mikkola, Kempele (FI); Tommi Lepistö, Oulu (FI)

(73) Assignee: LK Products Oy, Kempele (FI)

( * ) Notice: Subject to any disclaimer, the term of this patent is extended or adjusted under 35 U.S.C. 154(b) by 13 days.

(21) Appl. No.: 10/722,650

(22) Filed: Nov. 25, 2003

(65) Prior Publication Data

US 2004/0113845 A1 Jun. 17, 2004

(30) Foreign Application Priority Data

Dec. 16, 2002 (FI) ..... 20022198

(51) Int. Cl.
*H01Q 1/24* (2006.01)

(52) U.S. Cl. ..... 343/702; 343/700 MS

(58) Field of Classification Search ..... 343/700 MS, 343/702, 815, 860, 833, 834
See application file for complete search history.

(56) References Cited

U.S. PATENT DOCUMENTS

| | | | | |
|---|---|---|---|---|
| 2,745,102 | A * | 5/1956 | Norgorden | 343/834 |
| 4,827,266 | A * | 5/1989 | Sato et al. | 343/700 MS |
| 5,966,097 | A * | 10/1999 | Fukasawa et al. | 343/700 MS |
| 6,326,921 | B1 | 12/2001 | Egorov et al. | |
| 6,429,818 | B1 | 8/2002 | Johnson et al. | |
| 6,456,249 | B1 * | 9/2002 | Johnson et al. | 343/702 |
| 6,480,155 | B1 * | 11/2002 | Eggleston | 343/700 MS |
| 6,535,170 | B1 * | 3/2003 | Sawamura et al. | 343/702 |
| 6,657,593 | B1 * | 12/2003 | Nagumo et al. | 343/700 MS |
| 6,657,595 | B1 * | 12/2003 | Phillips et al. | 343/702 |
| 6,765,536 | B1 * | 7/2004 | Phillips et al. | 343/702 |
| 6,819,287 | B1 * | 11/2004 | Sullivan et al. | 343/700 MS |
| 7,084,831 | B1 * | 8/2006 | Takagi et al. | 343/860 |
| 2002/0105471 | A1 | 8/2002 | Kojima et al. | |
| 2006/0082514 | A1 * | 4/2006 | Chiang et al. | 343/794 |

FOREIGN PATENT DOCUMENTS

| | | | |
|---|---|---|---|
| EP | 0 923 158 | A2 | 6/1999 |
| EP | 1 162 688 | A1 | 12/2001 |
| JP | 2001 217631 | A1 | 8/2001 |
| WO | WO-02/13307 | A1 | 2/2002 |
| WO | WO-02/078124 | A1 | 10/2002 |

* cited by examiner

*Primary Examiner*—Tan Ho
(74) *Attorney, Agent, or Firm*—Darby & Darby

(57) ABSTRACT

An antenna intended to be used in a small-sized and flat radio device, and to a radio device which has an antenna according to the invention. The base element of the antenna is a monopole-type conductor (110) internal to the device. This conductor may be designed such that the harmonic nearest to the fundamental resonating frequency can be utilized in providing an upper operating band. In addition to the base element the antenna structure comprises a parasitic element (120) which functions as both an auxiliary radiator and antenna matching element. Matching is optimized using an inductive component (125) which connects the parasitic element to signal ground. The antenna gain achieved is considerably higher than that of known antenna structures occupying the same space (h), and the antenna matching is improved, compared to known internal monopole antennas.

16 Claims, 3 Drawing Sheets

ANTENNA FOR FLAT RADIO DEVICE

The invention relates to an antenna intended to be used in a small-sized and flat radio device. The invention also relates to a radio device which has an antenna according to the invention.

BACKGROUND OF THE INVENTION

Commercial portable radio devices, such as mobile phones, include models with a total device depth of about one centimeter, for example. Such flat structures are especially the folding parts of flip-type mobile phones. A flip phone has got two parts such that the parts can be folded over, on a hinge, so that they lie on top of each other or adjacently end-to-end in almost the same plane. In the first position, the device is particularly small, and it is in the latter position during connection.

Antennas used in flip phones are normally monopole-type external antennas. Their drawback is the inconvenience generally associated with a protruding structural element. Naturally it would be possible to use internal PIFA-type planar antennas, but the thin structure of the folding parts in the mobile phone would result in the distance between the radiating part and ground plane to be so small that the antenna gain would be unsatisfactory. Furthermore, it would be possible to have an internal monopole-type planar antenna such that the radiating plane does not face the ground plane. In that case the flatness of the device would cause no problem as such, but the electrical characteristics such as matching and antenna gain would again be unsatisfactory. Matching could be improved using an additional circuit, but this would require the use of several discrete components.

SUMMARY OF THE INVENTION

It is an object of the invention to eliminate the aforementioned drawbacks associated with the prior art. An antenna according to the invention is characterized in that which is specified in the independent claim 1. A radio device according to the invention is characterized in that which is specified in the independent claim 10. Some advantageous embodiments of the invention are specified in the other claims.

The idea of the invention is basically as follows: Base element of the antenna of a flat radio device is an internal monopole-type conductor. This conductor may be designed such that the harmonic nearest the fundamental resonating frequency can be utilized for providing an upper operating band. In addition to the base element the antenna structure includes a parasitic element which serves as both auxiliary radiator and antenna matching element. Matching is optimized by an inductive structure part which connects the parasitic element to signal ground.

One of the advantages of the invention is that it yields an antenna gain significantly higher than known antenna structures occupying the same space. Another advantage of the invention is that the antenna gain is better compared to known internal monopole antennas. Still another advantage of the invention is that the parasitic element according to the invention can be further used for widening at least one operating band by appropriately offsetting its resonating frequency from the corresponding resonating frequency of the base element. Still another advantage of the invention is that the arrangement according to the invention is simple and incurs relatively little production costs.

BRIEF DESCRIPTION OF THE DRAWINGS

The invention will now be described in detail. Reference is made to the accompanying drawings in which.

DETAILED DESCRIPTION OF THE INVENTION

Figure 1:
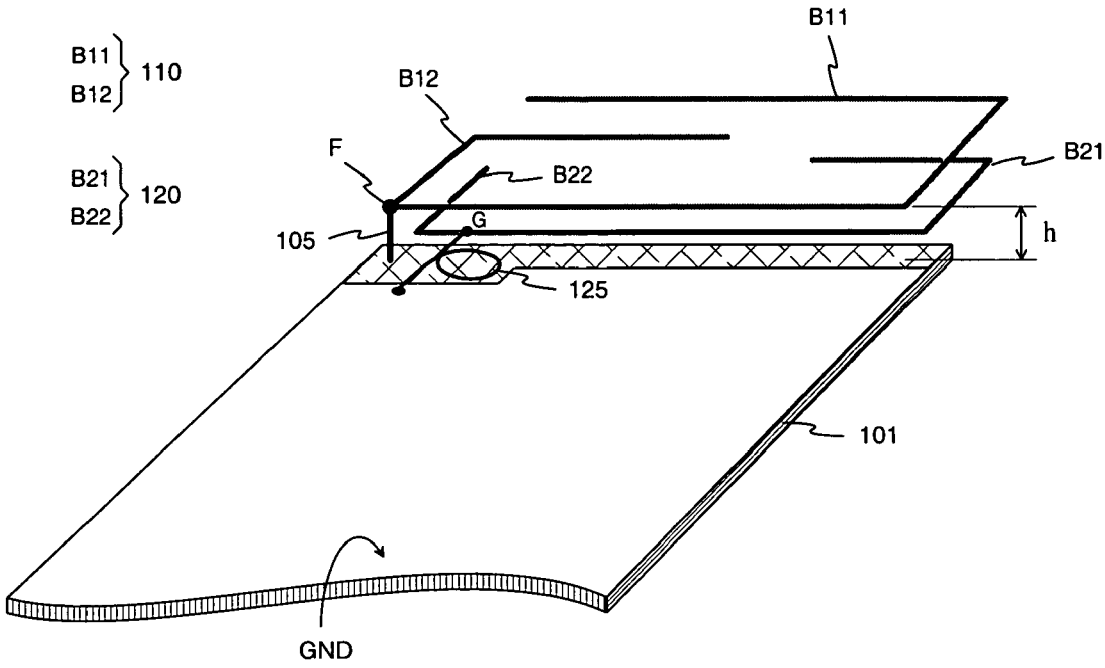
FIG. 1 shows an example of an antenna according to the invention.

FIG. 1 shows a first example of an antenna according to the invention. Shown is a radio device circuit board 101 to one end of which an antenna is connected. The main components of the antenna are a base element 110 and parasitic element 120. In this example the base element is a rigid conductive wire resembling an open rectangular ring. In a corner of the base element 110, situating on the circuit board 101 side, there is a feed point F which is connected to the antenna port of the radio device through a feed conductor 105. The antenna port and the transmitter and receiver of the radio device are located on the opposite side of the circuit board 101 and are not visible in FIG. 1. The upper surface of the circuit board is mostly conductive signal ground GND. This, however, does not extend to the antenna, so the base element 110 together with the feed conductor 105 constitute a monopole-type radiator. In this example the monopole radiator has got two bands. Its fundamental resonating frequency falls into a frequency range used by a first radio system, and the harmonic nearest the fundamental resonating frequency falls into a frequency range used by a second radio system. For achieving an appropriate ratio between the harmonic and the fundamental resonating frequency the base element 110 has got two branches: It is divided into a first branch B11 and a second, shorter, branch B12, as viewed from the feed point F. There is an electromagnetic coupling between the outer ends thereof, which decreases said ratio between the harmonic and the fundamental resonating frequency.

The parasitic element 120, too, is in this example a rigid conductive wire and it is located below the base element, approximately in the plane of the circuit board 101. The parasitic element is connected at its point G to signal ground GND through an inductive element 125. The latter is a conductive wire making one turn, approximately. Point G divides the parasitic element into two parts B21, B22. The first part B21 together with the inductive element resonates in the lower operating band of the antenna, i.e. in the frequency range used by the first radio system. The second part B22 together with the inductive element resonates in the upper operating band of the antenna, i.e. in the frequency range used by the second radio system. Oscillation energy naturally comes from the field of the base element through electromagnetic coupling. Thus, in this example, the parasitic element functions as an auxiliary radiator and enhances antenna gain in both operating bands of the antenna. The dimensions of the parts of the parasitic element and inductive element 125 are chosen so as to achieve optimal matching for the whole antenna.

By a structure like the one described above the object of the invention, i.e. an antenna which fits into a flat radio device and yet has sufficiently good electrical characteristics, is achieved. This means that the height h of the antenna, i.e. the perpendicular distance of the basic element 110 from the radio device circuit board 101, can be reduced, as compared to an equally good PIFA, for instance.

The parasitic element 120 can also be used to widen one or both of the operating bands. This is done in a manner, known as such, by making the base element resonating frequency and the parasitic element resonating frequency somewhat different. However, the frequency difference has to be limited such that the matching of the antenna remains good enough over the whole range between the resonating frequencies.

Figures 2A, 2B:
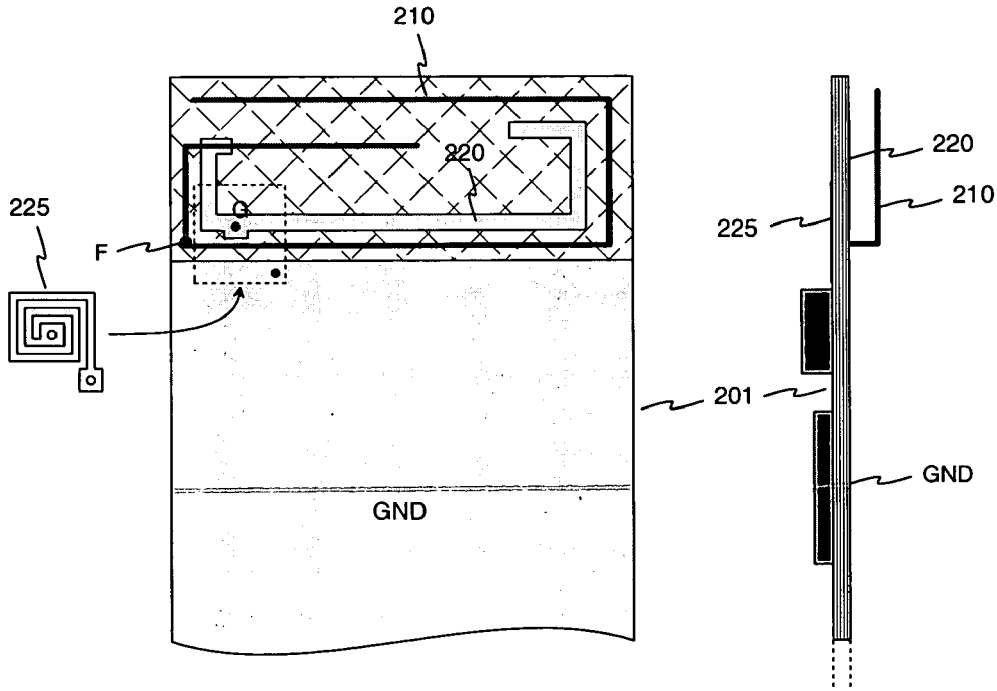
FIG. 2*a* shows a second example of an antenna according to the invention.
FIG. 2*b* shows a side view of the antenna of FIG. 2*a*.

FIGS. 2*a,b* show a second example of an antenna according to the invention. In FIG. 2*a* the structure is shown from above, and in FIG. 2*b* from the side. The antenna, like that in FIG. 1, comprises a radio device circuit board 201, antenna base element 210, parasitic element 220, and an inductive element 225 which connects the latter to signal ground. This structure differs from that of FIG. 1 in that both the parasitic element and inductive element are conductive strips on the circuit board 201. The inductive element 225 constitutes a spiral pattern and it is located on opposite side of the circuit board compared with the parasitic element 220.

Figure 3A:
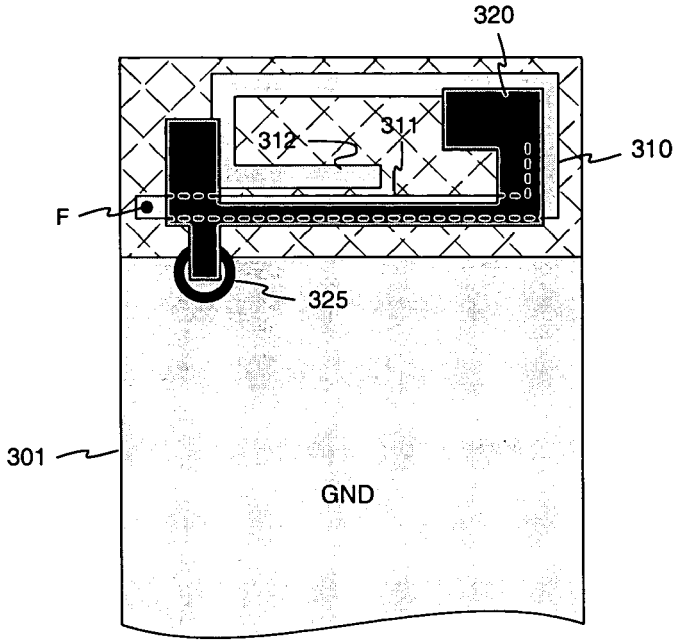
FIG. 3*a* shows a third example of an antenna according to the invention.
Figure 3B:
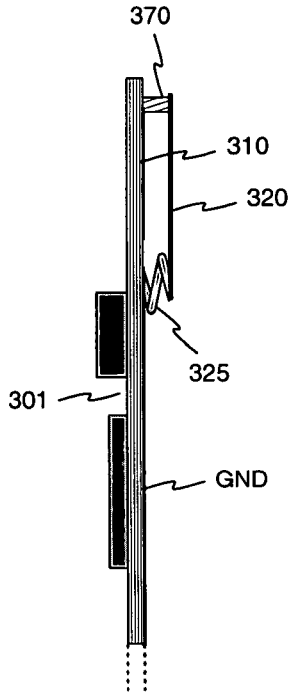
FIG. 3*b* shows a side view of the antenna of FIG. 3*a*, FIGS. 4*a,b* show an example of a radio device equipped with an antenna according to the invention.

FIGS. 3*a,b* illustrate a third example of an antenna according to the invention. In FIG. 3*a* the structure is shown from above, and in FIG. 3*b* from the side. The antenna includes a radio device circuit board 301, antenna base element 310, parasitic element 320, and an inductive element 325 which connects the latter to signal ground. In this example the base element 310 is a conductive strip on the circuit board 301. The base element is not branched like in FIGS. 1 and 2. Instead, its far end 312 is right beside the portion 311 starting from the feed point F in order to produce a relatively strong electromagnetic coupling. This design produces an appropriate ratio between the fundamental resonating frequency and its nearest harmonic. The parasitic element 320 is now located above the base element, i.e. elevated from the circuit board 301, and it is made of sheet metal by cutting. The inductive element 325 is a small coil of rigid wire, placed between an extension of the parasitic element and ground plane. FIG. 3*b* further shows a dielectric block 370 supporting the parasitic element on the circuit board.

Figure 4A:
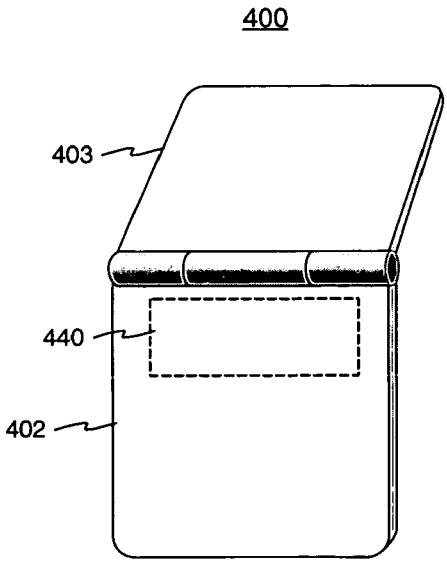
Figure 4B:
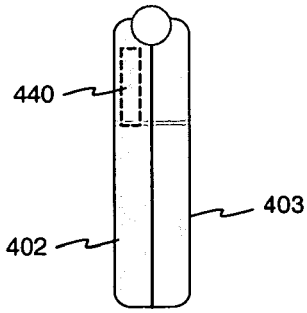

FIG. 4 shows an example of a radio device according to the invention. The radio device 400 is a flip-type mobile phone having a first part 402 and second part 403 which parts are beared by a hinge. These parts are considerably flatter than an ordinary mobile phone having a single covering. In FIG. 4*a*, the first and second parts make almost a straight angle between them, and in FIG. 4*b* they are turned face to face. An antenna 440 as described above is located within the first part 402. Naturally it could be placed within the second part 403 as well.

Figure 5:
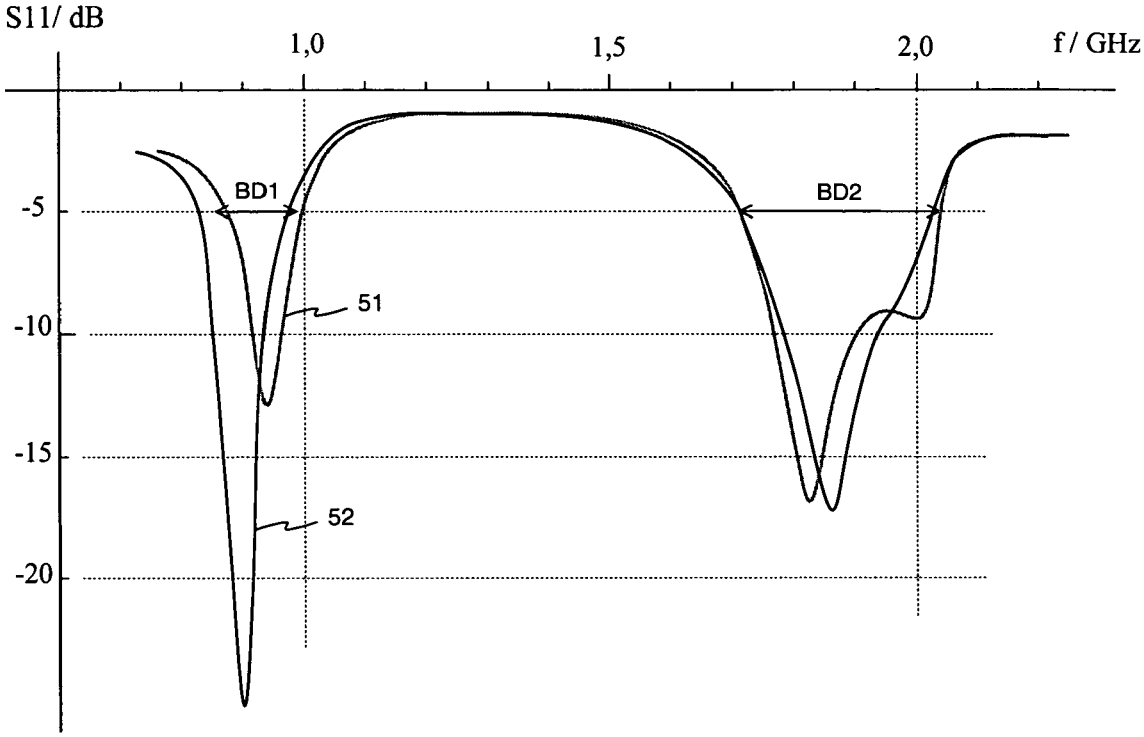
FIG. 5 shows an example of the matching of an antenna according to the invention.

FIG. 5 shows an example of the matching of an antenna according to the invention. The example relates to the antenna depicted in FIG. 1 in a flip-type mobile phone. The height h of the antenna is 3.5 mm. The quality of the matching appears from the values of the reflection coefficient S11. Curve 51 shows the variation of the reflection coefficient as a function of the frequency when the folding parts of the mobile phone are positioned face to face, and curve 52 shows the same variation when the mobile phone is open. The curves show that the lower one BD1 of the two operating bands of the antenna covers the frequency band of the GSM900 (global system of mobile communications), and the upper operating band BD2 covers those of the GSM1800 and GSM1900 systems, for example. The dimensions of the parasitic element are chosen such that especially the upper operating band is very wide. Opening the phone improves the matching especially in the lower operating band, at the same time shifting the latter down somewhat. Changes in the upper operating band are smaller.

Figure 6:
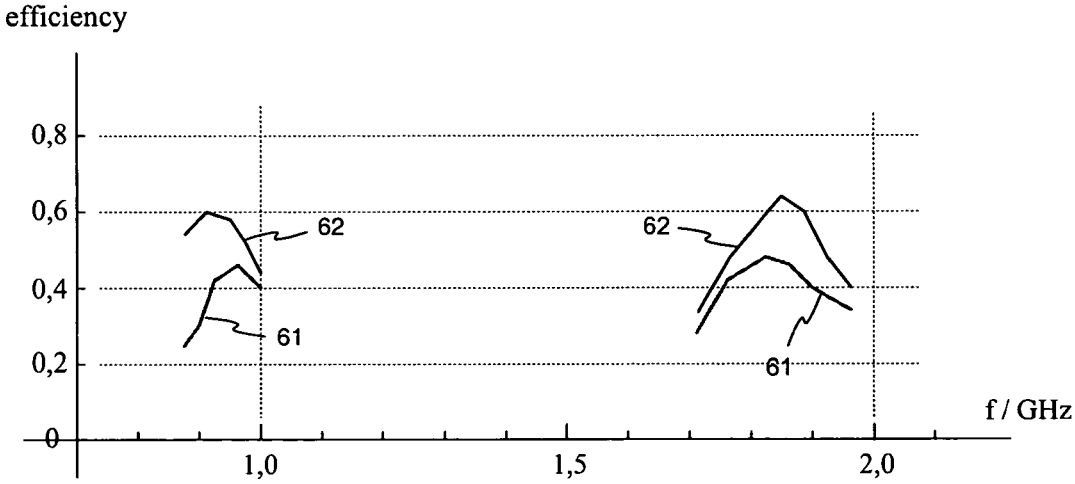
FIG. 6 shows an example of the efficiency of an antenna according to the invention.

FIG. 6 shows an example of the efficiency of an antenna according to the invention. The efficiencies are measured in a similar structure as matching curves in FIG. 5. Curve 61 shows the variation of the efficiency in the lower and upper operating bands when the folding parts of the mobile phone are positioned face to face, and curve 62 shows the same variation when the mobile phone is open. Looking at the curves one can see that opening the phone improves the efficiency in both the lower and upper operating band from about 0.4 to about 0.5–0.55. Given as antenna gain, i.e. relative field strength measured in the most favorable direction, the readings correspond to values greater than one.

When a flip-type phone is in the closed position, it suffices that signaling between it and a base station works. The results depicted in FIGS. 5 and 6 show that an antenna according to the invention is acceptable in this respect.

Some antenna structures according to the invention were described above. The invention does not limit the shapes and implementation of the antenna elements to those just described. The inventional idea can be applied in different ways within the scope defined by the independent claim 1.

What is claimed is:

1. An internal antenna for a flat radio device having a signal ground, the antenna comprising:

a monopole-type base element with a feed conductor;

a parasitic element functioning as an auxiliary radiator; and a single inductive matching element connected between the parasitic element and the signal ground to optimize antenna matching.

2. An antenna according to claim 1, said radio device having a circuit board, and the base element and the parasitic element being substantially on top of one another as viewed along the direction of the normal of said circuit board.

3. An antenna according to claim 2, the base element and the parasitic element being rigid conductive wires aside said circuit board as viewed along the direction of the normal of the circuit board.

4. An antenna according to claim 2, the parasitic element being a conductive strip on a surface of said circuit board and the base element being a rigid conductive piece.

5. An antenna according to claim 4, the matching element being a conductive strip on a surface of said circuit board.

6. An antenna according to claim 2, the base element being a conductive strip on a surface of said circuit board and the parasitic element being a rigid conductive piece.

7. An internal antenna for a flat radio device having a signal ground,the antenna comprising:

a monopole-type base element with a feed conductor, wherein said base element has a first branch and a second branch, between which branches being an electromagnetic coupling to set the ratio of the fundamental resonating frequency and its nearest harmonic of the base element such that the fundamental resonating frequency falls into frequency range of a first radio system and said nearest harmonic falls into frequency range of a second radio system;

a parasitic element functioning as an auxiliary radiator; and a single matching element connected between the parasitic element and the signal ground to optimize antenna matching.

8. An antenna according to claim 7, wherein a structure constituted of the parasitic element and the matching element has a first resonating frequency arranged to fall into frequency range of the first radio system, and a second resonating frequency arranged to fall into frequency range of the second radio system.

9. An internal antenna for a flat radio device having a signal ground, the antenna comprising:

a monopole-type base element with a feed conductor;

a parasitic element functioning as an auxiliary radiator; and a single matching element connected between the parasitic element and the signal ground to optimize antenna matching, wiherein the matching element is a wound conductive wire.

10. A radio device having a signal ground and an internal antenna, comprising:

a monopole-type base element with a feed conductor;

a parasitic element functioning as auxiliary radiator; and a single inductive matching element connected between the parasitic element and the radio device signal ground to optimize antenna matching.

11. A radio device having a signal ground and an internal antenna, comprising:

a monopole-type base element with a feed conductor;

a parasitic element functioning as an auxiliary radiator;

a single matching element connected between the parasitic element and the radio device signal ground to optimize antenna matching; and the radio device having a first part and a second part such that these parts can be turned on a hinge one upon another, said antenna being located within the first part.

12. An internal antenna for a flat radio device having a signal ground, the antenna comprising:

a monopole-type base element including a feed conductor;

a parasitic element functioning as an auxiliary radiator;

a single matching element connected between the parasitic element and the signal ground to optimize antenna matching; and the flat radio device includes a circuit board;

wherein the base element and the parasitic element are substantially on top of one another as viewed along the direction of the normal of said circuit board.

13. An antenna according to claim 12, wherein the base element and the parasitic element are rigid conductive wires disposed aside said circuit board as viewed along the direction of the normal of the circuit board.

14. An antenna according to claim 13, wherein the matching element is a conductive strip on a surface of said circuit board.

15. An antenna according to claim 12, wherein the parasitic element is a conductive strip on a surface of said circuit board, and the base element is a rigid conductive piece.

16. An antenna according to claim 12, wherein the base element is a conductive strip on a surface of said circuit board, and the parasitic element is a rigid conductive piece.

* * * * *